US005124057A

United States Patent [19]

Cohen

[11] Patent Number: 5,124,057

[45] Date of Patent: Jun. 23, 1992

[54] SYNERGISTIC ANTIOXIDANT SYSTEM FOR SEVERELY HYDROCRACKED LUBRICATING OILS

[75] Inventor: Stephen C. Cohen, Thornhill, Canada

[73] Assignee: Petro-Canada Inc., North York, Canada

[21] Appl. No.: 645,919

[22] Filed: Jan. 25, 1991

[51] Int. Cl.[5] ..... C10M 141/06; C10M 141/10

[52] U.S. Cl. ..... 252/49.8; 252/51.5 A; 252/403

[58] Field of Search ..... 252/49.8, 51.5 A, 403

[56] References Cited

U.S. PATENT DOCUMENTS

| | | | |
|---|---|---|---|
| 3,043,775 | 7/1962 | Coffield et al. . | |
| 3,115,463 | 12/1963 | Orloff et al. . | |
| 3,115,464 | 12/1963 | Orloff et al. . | |
| 3,115,465 | 12/1963 | Orloff et al. . | |
| 3,531,483 | 9/1970 | Gilles | 252/589 |
| 3,556,999 | 1/1971 | Messina et al. . | |
| 3,642,690 | 2/1972 | Mills . | |
| 3,652,411 | 3/1972 | Connichau . | |
| 3,678,047 | 7/1972 | Kletecka et al. | 252/401 |
| 3,758,549 | 9/1973 | Dexter et al. . | |
| 3,923,672 | 12/1975 | Durr et al. . | |
| 4,025,486 | 5/1977 | Gilles . | |
| 4,119,549 | 10/1978 | Davis . | |
| 4,374,219 | 3/1983 | Spivack et al. . | |
| 4,385,984 | 5/1983 | Bijwaard . | |
| 4,611,024 | 9/1986 | Wolfe | 252/403 |
| 4,612,131 | 9/1986 | Rosenberger . | |
| 4,652,385 | 3/1987 | Cohen . | |
| 4,753,972 | 6/1988 | Ravichandran | 252/401 |
| 4,780,495 | 10/1988 | Lai et al. | 252/51.5 A |

FOREIGN PATENT DOCUMENTS

| | | |
|---|---|---|
| 1185962 | 4/1985 | Canada . |
| 0107282 | 2/1984 | European Pat. Off. . |
| 0165209 | 6/1984 | European Pat. Off. . |
| 1165226 | 9/1969 | United Kingdom . |
| 1569433 | 6/1980 | United Kingdom . |

OTHER PUBLICATIONS

*CRC Handbook of Chemistry and Physics*; CRC Press, 1990; 71st Edition; pp. 3-180, 3-181, 3-182, and 2-285.

*The Merck Index*, Tenth Edition; Merck & Co., Inc., 1983; pp. 693, 326, and 327.

*Primary Examiner*—Jacqueline Howard

*Attorney, Agent, or Firm*—Bereskin & Parr

[57] ABSTRACT

Lubricant compositions are disclosed in which a synergistic combination of low-volatility tri-substituted phosphite and selected substituted isocyanurate phenolic stabilizers provide surprisingly effective antioxidant qualities to lubricating oils selected from hydrotreated oils, poly-α-olefin oils, paraffinic white oils and mixtures thereof.

12 Claims, No Drawings

SYNERGISTIC ANTIOXIDANT SYSTEM FOR SEVERELY HYDROCRACKED LUBRICATING OILS

FIELD OF THE INVENTION

The present invention relates to novel lubricating oil compositions, and particularly to lubricating oil compositions containing a novel stabilizer/antioxidant system comprising high molecular weight phosphites and hindered phenols.

BACKGROUND TO THE INVENTION

In most applications of lubricating oils which are to be used at elevated temperatures, it is desirable that the lubricating oil formulation exhibit good oxidation resistance, in order to minimize or prevent the increase in viscosity, formation of sludge and acidity of the lubricant, and the consequent lowering of the lubricating ability of the oil and lubricating system in general.

In the prior art, many materials have been disclosed to improve high-temperature oxygen stability and resistance to discoloration, including calcium naphtha sulphonates, barium versatates, calcium phenates, and various phenols, phosphates and phosphites. However, conventional stabilizing/antioxidant systems, which are typically used in naphthenic and solvent-refined lubricating oils, have shown limited success when used with certain primarily paraffinic lubricating oils, namely hydrotreated oils, poly-α-olefin oils, paraffinic white oils and mixtures thereof. Different lubricating oils do react in different ways to different antioxidant systems. As has been shown in the past, the effect of an antioxidant mixture in a lubricating oil is a function of the sulphur level and the aromatic content of the lubricating oil. As is discussed in more detail below, the hydrotreated oils used in this invention typically contain less than about 1 per cent total aromatics and, preferably, less than about 0.25 per cent aromatics. Further, these hydrotreated oils typically have a sulphur level less than about 50 ppm and, in some cases the oils may have a sulphur level less than about 1–2 ppm. On the other hand, sulphur-refined and naphthenic oils have corresponding levels which are at least one to two orders of magnitude larger. Hence there is a need for a reliable stabilizing system for use with hydrotreated oils, poly-α-olefin oils, paraffinic white oils and mixtures thereof.

Phosphites are known in the art as stabilizers for lubricating oils. In U.S. Pat. No. 3,652,411, Commichau discloses a mixture of phosphite, phenol, substituted amine, organic phosphate, polyhydroxyquinone and benzotriazole as a stabilizer for polyglycol lubricant. There was no discussion of subcombinations of this rather complex mixture. Orloff et.al. in U.S. Pat. No. 3,115,463 discloses the stabilization of mineral oils and synthetic diester oils by a synergistic mixture of dialkyl hydrogen phosphite and substituted phenol or bisphenol. U.S. Pat. No. 3,115,464 by the same inventors discloses an orthoalkyl phenol in admixture with dialkyl hydrogen phosphite, where the alkyl groups were isopropyl or tertiary butyl. Spivack et.al. in U.S. Pat. No. 4,374,219 discloses a phosphite stabilizer which was an alkanolamine ester of a non-cyclic and a cyclic phosphite. It was said to be useful as a stabilizer for lubricating oils and polymers, alone or in combination with selected hindered phenols. In U.S. Pat. No. 3,556,999, Messina discloses a stabilized hydraulic fluid containing a lubricating oil, a phosphite or disubstituted phosphate, a substituted phenol or an aromatic secondary amine and an oil-soluble dispersant copolymer. See also U.S. Pat. No. 3,115,465 by Orloff et.al. which discloses a further particular combination of phenols and phosphites. In particular, these latter two patents use phosphites which have a relatively low molecular weight and do not have low volatility as defined herein.

However, severely hydrotreated oils present particular problems for stabilizers in hot oxygen or air exposure of lubricating oils, as acknowledged in U. S. Pat. No. 4,385,984 of Bijwaard et.al. That patent discloses a hydrotreated oil having poor oxidation stability to which was added a substantial quantity of less severely hydrotreated oil containing some remaining sulphur. Nevertheless, there remains a need for a really effective stabilizer for use with hydrotreated oils, poly-α-olefins and paraffinic white oils.

In U.S. Pat. No. No. 4,025,486, Gilles discloses a stabilizer for stabilizing polyolefin polymers from degradation when exposed to ultraviolet light. The stabilizer comprises a mixture of hydroxyphenyl-alkyleneyl isocyanurates and a pentaerythritol phosphite. As is apparent from the foregoing, the isocyanurates were used as a stabilizer to prevent degradation from ultraviolet light. Further, the stabilizer was for use with a polymer and not a lubricating oil.

In U.S. Pat. No. No. 4,652,385 and corresponding Canadian Pat. No. No. 1,248,516, there is disclosed a lubricating composition comprising a major amount of lubricating oil selected from the group consisting of hydrotreated oil, poly-α-olefin oil and paraffinic white oil, and an antioxidant amount of a synergistic mixture of:

(a) a low-volatility, hydrolytically stable, organically substituted phosphite or diphosphite, wherein the substituent groups are alkyl, aryl or alkylaryl, and said phosphite contains substantially no hydroxy groups, and (b) a low-volatility sterically hindered phenolic compound.

In particular, these patents disclose a synergistic mixture wherein the phenolic compound is selected from the group having the formulae:

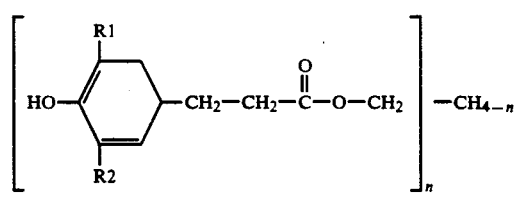

(i)

wherein R1 and R2 are, independently, isopropyl or tertiary butyl, and n is 2, 3, or 4, and

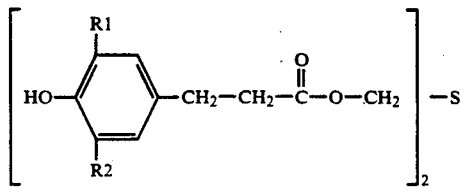

(ii)

where R1 and R2 are, independently, isopropyl or tertiary butyl.

SUMMARY OF THE INVENTION

It has now been surprisingly found that a synergistic mixture of phosphites and phenols for a lubricating composition comprising a major amount of lubricating oil selected from the group consisting of hydrotreated oil, poly-α-olefin oil and paraffinic white oil may also be produced by combining:

(a) a low-volatility, hydrolytically stable, organically substituted phosphite or diphosphite, wherein the substituent groups are alkyl, aryl or alkylaryl, and said phosphite contains substantially no hydroxy groups, and (b) tris (2-hydroxyethyl-3,5-di-tert-butyl-hydroxy-cinnamate) isocyanurate or tris (3,5-di-tert-butyl)-4-hydroxybenzyl isocyanurate.

DETAILED DESCRIPTION OF THE INVENTION

Lubricating compositions according to this invention exhibit superior oxidation resistance as measured by, for example, an IP-48 test carried out for 24 hours at 200° C. In this test, the sample is subjected to relatively severe oxidation conditions by heating to 200° C. and passing air through it at 15 liters per hour. For the purposes of the present disclosure the oxidation was carried out for four six-hour periods instead of the normal two periods, such that the sample was subjected to oxidation for 24 hours in total. The change in viscosity and in Total Acid Number of the sample are the properties of primary interest and are reported herein. At the same time, the compositions according to the invention exhibit no significant discoloration after 24 hours in the modified IP-489 test. It is also advantageous in many applications that the lubricants of the invention exhibit high clarity throughout their operating life for several reasons, including the reason that a clear lubricant can be seen by eye not to contain significant amounts of suspended solids; because suspended solids can be abrasive in use, it is useful that their absence can be detected visually.

For good performance at high temperatures of the lubricating compositions of this invention, it is critical that the volatility of the stabilizing antioxidants be low at elevated temperatures. In this specification, low volatility denotes a material that in a thermogravimetric analysis, loses no more than 5 per cent of its mass below 180° C., when heated in air at a rate of 10 to 20° C./min, and further that the rate of weight loss is low up to 250° C. so that preferably the 50 per cent loss temperature is above 300° C. This characteristic is especially suitable in lubricating compositions for use in heat transfer oils and compressor oils which are generally subjected to high temperatures (180° C.–300° C.) service. Such low volatility is required of both the phenol and the phosphite antioxidants in the synergistic combination of the invention.

The phenols utilized according to the instant invention are hindered phenols. More specifically, the phenols which may be used in accordance with the present invention are tris (3,5-di-tert-butyl)4-hydroxybenzyl isocyanurate or tris (2-hydroxyethyl-3,5-tert-butyl-hydroxy-cinnamage) isocyanurate. While both the isocyanurate and the cinnamate isocyanurate show surprising synergistic effects in the antioxidant combination of the present invention, the cinnamate isocyanurate shows a much more pronounced synergistic effect and is preferred.

The phosphite or diphosphite in the compositions of the invention is preferably selected from aromatic phosphites of the following formulae:

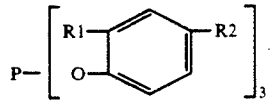

(i)

where R1 and R2 are, independently, alkyl group having from three to six carbon atoms, and

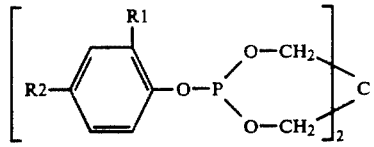

(ii)

where R1 and R2 are, independently, alkyl groups having from three to six carbon atoms. The phosphites in the compositions of the invention must be hydrolytically stable, as measured by the ASTM D2619 test. In this test the lubricating oil final composition including the stabilizing mixture is maintained in contact with water at 93° C. in the presence of a copper coupon for 48 hours. The weight loss of the coupon is measured, together with the acidity of the water layer and other properties. The test measures the propensity of the additives to be hydrolysed in the presence of water, heat and active metals. In this test, a hydrolytically stable lubricating oil composition should produce an increase in acidity in the water layer of no more than 1 mg KOH and Total Acid Number change in the oil layer of no more than 0.1; and the weight loss of the copper coupon should not exceed 0.1 mg/cm$^2$. The successful phosphites that are within the scope of the invention are tri-substituted, that is, having all three of the hydrogen atoms replaced by organic substituent groups. Preferred phosphites in the compositions of the invention are: tris-(2,4-di-tert-butylphenyl) phosphite and bis-(2,4-di-tert-butylphenyl pentaerythritol) di-phosphite.

The stabilizers of the invention are used in antioxidant amounts in the lubricating compositions. Generally the total weight of stabilizers is from 0.05 per cent to 2 per cent, and preferably from 0.1 per cent to 1 per cent, of the lubricating oil. The mixture of phenol and phosphite has been found to have synergistic effect throughout the range of mixture ratios. The weight ratio of phenol:phosphite is preferably from 1:6 to 1:2 where the phosphite stabilizer comprises a phosphite of formula (i) having one phosphorus atom per molecule, and from 1:5 to 1:1 where the phosphite stabilizer is of formula (ii) having two phosphorus atoms per molecule.

The compositions of the invention are made from lubricating oil selected from the group consisting of poly-α-olefin oils, paraffinic white oils and in particular, hydrotreated oils. Hydrotreated oils, as that term is used herein, are also known as severely hydrotreated oils and hydrocracked oils, may be made from vacuum gas oil fractions which have been subjected to a two-stage high-hydrogen-pressure hydrotreating process in the presence of active catalysts. Aspects of such process are disclosed in U.S. Pat. Nos. 3,493,493, 3,562,149, 3,761,388, 3,763,033, 3,764,518, 3,803,027, 3,941,680 and 4,285,804. In the first stage of a typical hydrotreatment process, the hydrogen pressure is in the vicinity of 20

MPa and the temperature is maintained at about 390° C., using a fluorided Ni-W catalyst on a silica-alumina support; nitrogen-, sulphur- and oxygen-containing compounds are almost entirely removed from the feedstock; and other effects include a high degree of saturation of aromatics and a high degree of ring scission of the polycyclic intermediates. Lubricating oil fractions from the first stage are dewaxed and subjected to further hydrogen treatment in the presence of a catalyst, for example, Ni-W on a silica-alumina support, at lower temperature than the first stage. Aromatics and olefins are further saturated in this stage. The product oil contains substantially no sulphur or nitrogen, and only trace amounts of aromatics, being substantially entirely composed of saturates including paraffins and cycloparaffins.

Examples of typical oils are shown in Table 1. Severely hydrotreated oils are available from several manufacturers, two of which are included in the Table as representative of the type. The hydrotreated oils set out in Table 1 contain from 0.26 to 0.03 per cent aromatics. On the other hand, conventional solvent-refined paraffinic oils and naphthenic base oils contain about 14 and about 31 per cent aromatics respectively. This demonstrates at least one or two orders of magnitude difference in the aromatic content of conventional lubricating oils and hydrotreated lubricating oils. A similar difference is shown in the sulphur level. The hydrotreated oils of Table 1 have sulphur levels of 2 and 53 ppm. The conventional oils set out in Table 1, on the other hand, contain sulphur levels several orders of magnitude higher.

Poly-α-olefin oils are manufactured by oligomerizing olefins, for example n-decene, which are then saturated to remove the remaining double bond. These materials by their nature contain no sulphur, nitrogen, oxygen or aromatics.

Paraffinic white oils are made from conventional naphthenic or solvent-refined lubricating oils by contact with concentrated sulphuric acid to remove aromatics, sulphur and nitrogen compounds. In recent years the acid treatment has been supplemented by first subjecting the feedstocks to a mild hydrogen treatment.

All three types of lubricating oils are similar in that they contain substantially no aromatics or unsaturated compounds and substantially no heteroatoms. It is not clear whether the synergistic effect of the phenol and phosphite antioxidants of the invention occur because of the substantially saturated nature of the lubricating oils to be protected, or because of the absence of heteroatoms. What is known is that the same combinations of antioxidants in naphthenic and solvent-refined lubricating oils are not synergistic in their protection against oxidation.

In addition, the lubricating compositions of the invention can include other additives as necessary for the specific application in which the lubricating oils are to be used, for example, rust inhibitors, defoamers, demulsifiers, extreme pressure additives, viscosity index improvers and pour point depressants. All of these materials are well known in the art of formulating lubricating oils, and the person skilled in the art will be aware of the need to select thermally stable additives suitable to the end-use application of the particular lubrication product.

By way of example, typical lubricant products including lubricating compositions according to the invention include the following. All amounts of ingredients are shown as percentages by weight and the remainder is hydrotreated, paraffinic white, or poly-α-olefin lubricating oil to make up 100 per cent of the formulation.

| | |
|---|---|
| 1. Hydraulic Oil | |
| Tris (2-hydroxyethyl-3,5-di-tert-butyl-hydroxy-cinnamate) isocyanurate | 0.1–0.2% |
| Tris-(2,4-di-tert-butylphenyl) phosphite | 0.04–0.2% |
| Rust Inhibitor | 0.1% |
| Demulsifier | 25 ppm |
| Defoamer | 200 ppm |
| Pour point depressant | 0.2% |
| Copper corrosion inhibitor | 0.03% |
| 2. Steam Turbine Oil | |
| Tris (2-hydroxyethyl-3,5-di-tert-butyl-hydroxy-cinnamate) isocyanurate | 0.1–0.2% |
| Tris-(2,4-di-tert-butylphenyl) phosphite | 0.1–0.2% |
| Rust Inhibitor-alkylsuccinate | 0.1% |
| Demulsifier | 25 ppm |
| Defoamer | 200 ppm |
| Pour point depressant | 0.2% |
| Copper corrosion inhibitor | 0.03% |
| 3. Compressor Oil | |
| Tris (2-hydroxyethyl-3,5-di-tert-butyl-hydroxy-cinnamate) isocyanurate | 0.2–0.4% |
| Tris-(2,4-di-tert-butylphenyl) phosphite | 0.2–0.5% |
| Rust Inhibitor-alkylsuccinate | 0.05% |
| Demulsifier | 25 ppm |
| Defoamer | 200 PPM |
| Pour point depressant | 0.2% |
| Detergent or dispersant | 0.3% |
| Antiwear Additive | 0.5% |
| 4. Heat Transfer Oil | |
| Tris (2-hydroxyethyl-3,5-di-tert-butyl-hydroxy-cinnamate) isocyanurate | 0.1–0.4% |
| Tris-(2,4-di-tert-butylphenyl) phosphite | 0.2–0.5% |
| Rust Inhibitor | 0.05% |
| Detergent or Dispersant | 0.1% |

The compositions of the invention are made by normal blending and mixing techniques, generally at room temperature or slightly elevated temperature to aid in dissolution of the ingredients. Any of the generally-used types of blending apparatus can be employed, including fixed in-line blenders are batch stirrers.

It will be seen that lubricant compositions according to the invention are advantageous for use in applications where the lubricant is exposed to an oxidizing environment and high temperatures, for example compressor oils, heat transfer oils, hydraulic fluids and steam turbine oils.

EXAMPLE 1

Several lubricating oil compositions exemplifying the invention were made by mixing a hindered phenol, namely tris (2-hydroxyethyl-3,5-di-tert-butyl-hydroxy-cinnamate) isocyanurate, a phosphite namely tris (2,4-di-tert-butyl-phenyl) phosphite and hydrotreated lubricating oil of ISO 32 grade manufactured by Gulf Canada (now Petro-Canada), in the proportions shown in Table 2. The results of an extended IP-48 oxidation stability test on each mixture are shown in the Table, and illustrate the synergistic action of the antioxidant mixture.

EXAMPLE 2

Example 1 was repeated except the hindered phenol was tris(3,5-di-tert-butyl)-4-hydroylbenzyl isocyanurate. The results are set out in Table 3. Once again, the results illustrate the synergistic action of the antioxidant mixture.

TABLE 1

| | Typical Composition of Lubricating Oils | | | |
|---|---|---|---|---|
| | Severely Hydrotreated (Gulf Canada) | Severely Hydrotreated (Chevron Corp.) | Solvent Refined Paraffinic | Naphthenic Basestock |
| Viscosity Grade (SUV at 38.4° C.) | 160 | 100 | 160 | 100 |
| Total Saturates, per cent | 99.97 | 99.74 | 84.14 | 58.22 |
| Paraffins (iso + normal) | 32.60 | 35.60 | 17.74 | 12.22 |
| Cycloparaffins (total) | 67.37 | 64.14 | 66.40 | 46.00 |
| Monocyclo | (30.81) | (32.04) | (24.46) | (15.69) |
| Dicyclo | (19.52) | (17.96) | (15.24) | (12.82) |
| Tricyclo | (8.87) | (7.81) | (9.10) | (8.21) |
| Tetracyclo | (4.75) | (4.15) | (10.58) | (6.01) |
| Pentacycle | (2.56) | (1.80) | (4.67) | (2.45) |
| Hexacyclo | (0.86) | (0.34) | (2.35) | (0.82) |
| Total Aromatics, per cent | 0.03 | 0.26 | 14.37 | 31.06 |
| Monoaromatics | (0.03) | (0.17) | (10.49) | (12.28) |
| Diaromatics | Nil | (0.06) | (2.60) | (12.58) |
| Triaromatics | Nil | (0.03) | (0.48) | (2.72) |
| Tetra aromatics | Nil | Nil | (0.13) | (2.28) |
| Penta aromatics | Nil | Nil | (0.67) | (1.20) |
| Thiophenes (Total), per cent | Nil | Nil | 0.19 | 9.09 |
| Total Polar Compounds, per cent | Nil | Nil | 1.30 | 1.64 |
| S, ppm | 2 | 53 | 500 | 13,400 |
| N, ppm | 1 | 5 | 30 | 160 |

TABLE 2

| | Example 1 | | | | | |
|---|---|---|---|---|---|---|
| | Run Number | | | | | |
| | 1 | 2 | 3 | 4 | 5 | 6 |
| Composition | | | | | | |
| Tris(2-hydroxyethyl-3,5-di-tert-butyl hydroxy-cinnamate) isocyanurate | 0.00% | 0.10% | 0.125% | 0.25% | 0.375% | 0.50% |
| Tris-(2,4-di-tert-butyl-phenyl) phosphite | 0.50 | 0.40 | 0.375 | 0.25 | 0.125 | 0.00 |
| ISO 32 hydrotreated lubricating oil (Gulf Canada) | 99.50 | 99.50 | 99.50 | 99.50 | 99.50 | 99.50 |
| Oxidation Stability (24 hours, IP-48) | | | | | | |
| Viscosity increase at 40° C., per cent | 912 | 5.9 | 5.5 | 51.7 | 426 | 756 |
| Total Acid Number increase | 15.3 | .12 | 0.01 | 6.1 | 11.8 | 13.5 |

TABLE 3

| | Example 2 | | | | | |
|---|---|---|---|---|---|---|
| | Run Number | | | | | |
| | 1 | 2 | 3 | 4 | 5 | 6 |
| Composition | | | | | | |
| Tris(3,5-di-tert-butyl)-4-hydroxybenzyl isocyanurate | 0.00% | 0.10% | 0.125% | 0.25% | 0.375% | 0.50% |
| Tris-(2,4-di-tert-butyl-phenyl) phosphite | 0.50 | 0.40 | 0.375 | 0.25 | 0.125 | 0.00 |
| ISO 32 hydrotreated oil (Gulf Canada) | 99.50 | 99.50 | 99.50 | 99.50 | 99.50 | 99.50 |
| Oxidation Stability (24 hours, IP-48) | | | | | | |
| Viscosity increase at 40° C., per cent | 912 | 401 | 331 | 465 | 766 | 827 |
| Total Acid Number increase | 15.3 | 10.9 | 10.0 | 12.4 | 13.8 | 14.1 |

I claim:

1. A lubricating composition comprising a major amount of lubricating oil selected from a group consisting of hydrotreated oil, poly-α-olefin and paraffinic white oil, and an antioxidant amount of a synergistic mixture of:

(a) a low-volatility, hydrolytically stable, organically substituted phosphite or diphosphite, wherein the substituent groups are alkyl, aryl or alkylaryl, and the phosphite contains substantially no hydroxy groups, and (b) tris (2-hydroxyethyl-3,5-di-tert-butyl-hydroxy-cinnamate) isocyanurate or tris (3,5-di-tert-butyl)-4-hydroxybenzyl isocyanurate.

2. A lubricating composition as claimed in claim 1, wherein said phosphite or diphosphite is selected from the group having the formulas:

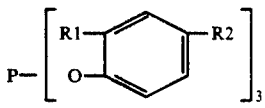

(i)

wherein R1 and R2 are, independently, alkyl groups having from three to sic carbon atoms, and (ii)

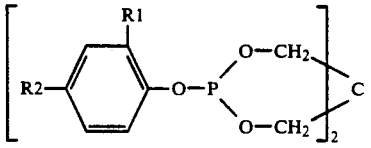

wherein R1 and R2 are, independently alkyl groups having from three to sic carbon atoms.

3. A lubricating oil as claimed in claim 2 wherein said phosphite or diphosphite is of formula (i) and the ratio of isocyanurate to phosphite is from about 1:6 to 1:2 by weight.

4. A lubricating composition as claimed in claim 2 wherein said phosphite or diphosphite is of the formula (ii) and the ratio of isocyanurate to phosphite is from about 1:5 to 1:1 by weight.

5. A lubricating composition as claimed in claim 1, 3 or 4 wherein the total amount of said stabilizers is from about 0.1 per cent to 1 per cent of said lubricating composition.

6. A lubricating composition as claimed in claim 2 wherein said phosphite or diphosphite is of the formula (i) and R1 and R2 are tertiary butyl.

7. A lubricating composition as claimed in claim 2 wherein said phosphite or diphosphite is of the formula (ii) and R1 and R2 are tertiary butyl.

8. A lubricating composition as claimed in claim 2, 3 or 4 wherein said lubricating oil comprises hydrotreated oil.

9. A lubricating composition as claimed in claim 2, 3 or 4 wherein said lubricating oil comprises poly-α-olefin.

10. A lubricating composition as claimed in claim 2, 3 or 4 wherein said lubricating oil comprises paraffinic white oil.

11. A lubricating composition as claimed in claim 1, 2 or 3 wherein said lubricating nil comprises a hydrotreated oil which is a vacuum gas oil fraction which has been subjected to a two-stage high-hydrogen pressure hydrotreating process in the presence of active catalysts, and is characterized by near total absence of aromatics, unsaturates, sulphur and nitrogen.

12. A lubricating composition as claimed in claim 1, 2, 3 or 4 wherein said isocyanurate is tris (2-hydroxyethyl-3,5-di-tert-butyl-hydroxy-cinnamate) isocyanurate.

* * * * *